United States Patent [19]

Guttinger et al.

[11] 4,004,870

[45] Jan. 25, 1977

[54] DUAL-BELT COOLING SYSTEM

[75] Inventors: Manfred Guttinger, Stuttgart; Konrad Schermutzki, Schmiden, both of Germany

[73] Assignee: Sandco Ltd., Ottawa, Canada

[22] Filed: June 4, 1975

[21] Appl. No.: 583,515

[30] Foreign Application Priority Data

June 5, 1974 Germany ..... 2427058

[52] U.S. Cl. ..... 425/224; 264/216; 425/371; 425/446; 425/DIG. 9; 62/374

[51] Int. Cl.[2] ..... B29C 23/00

[58] Field of Search ..... 425/223, 224, 4 C, DIG. 9, 425/371, 404, 445, 446; 62/374; 264/216

[56] References Cited

UNITED STATES PATENTS

| | | | |
|---|---|---|---|
| 2,069,589 | 2/1937 | Meijling et al. | 425/371 |
| 3,065,500 | 11/1962 | Berner | 425/4 C |
| 3,403,527 | 10/1968 | Berreth et al. | 62/374 X |
| 3,436,927 | 4/1969 | Gruber | 62/320 |
| 3,526,556 | 9/1970 | Berner | 425/4 C X |
| 3,709,964 | 1/1973 | Geest et al. | 425/224 X |

*Primary Examiner*—Robert L. Spicer, Jr.
*Attorney, Agent, or Firm*—Harold L. Stults

[57] ABSTRACT

A dual-belt system for solidifying products such as hot-melt resins by passing a product layer through a treatment zone formed by two endless steel belts. The product layer is precooled so that the product strip has substantially the desired cross-sectional shape prior to entering the treatment zone. During the precooling step the product spreads by the action of gravity, and the rates of precooling and movement are such as to insure that the product strip has dimensions within acceptable tolerances.

4 Claims, 2 Drawing Figures

DUAL-BELT COOLING SYSTEM

This invention relates to a dual-belt cooling system with coextensive runs of endless belts which move together upon the opposite sides of a treatment zone within which there is a product layer to be cooled. Such systems have means for applying a cooling liquid to the remote sides of the coextensive belt runs so that the top and bottom sides of the product layer be cooled. This invention relates particularly to cooling highly viscous liquids.

Dual-belt cooling systems have been developed (German design Pat. No. 7,304,916) in which a product is cooled in a treatment zone between the belts, and there are disposed along the belts spraying means through which cooling brine is sprayed on to the belts. The brine cools, either because some of the water in it evaporates, removing the necessary heat of evaporation from the belt and hence from the product layer to be cooled or because the brine removes the heat simply by heat transfer due to its lower temperature. It has now been found that a problem arises with such systems in the cooling of certain materials which are deposited on the lower revolving belt in a relatively liquid or viscous state. That problem is that the product or material to be cooled tends to flow laterally out of the treatment zone because the two belt portions are urged toward each other by the pressure necessary for effecting the cooling. As a result, the entire belt width cannot be fully utilized because it is necessary to prevent lateral runoff of the product. Furthermore, the belts are spaced from each other throughout the treatment zone the precise distance of the thickness of the layer or strip of the product so as to insure continuous contact between each of the belts and the product, thus insuring the uniform and satisfactory cooling of the product. When a product is still in flowable condition at the time it passes into the treatment zone, it tends to flow to the sides so that the layer or strip is thinner than desired and the continuous contact with both belts is not maintained. That in turn causes areas of the product to be undercooled, particularly at the top of the product layer or strip. For these reasons, dual-belt cooling systems of conventional design can be used to cool high-viscosity liquids only to a limited extent, and only with the drawbacks of reduced capacity and results which may not be completely satisfactory.

The object of the present invention is to overcome these drawbacks and provide cooling systems in which products and particularly high viscous liquids can be treated with full utilization of the cooling capacity, and which offers improved performance, along with reduced space requirements when used with other materials to be cooled.

Figure 1:
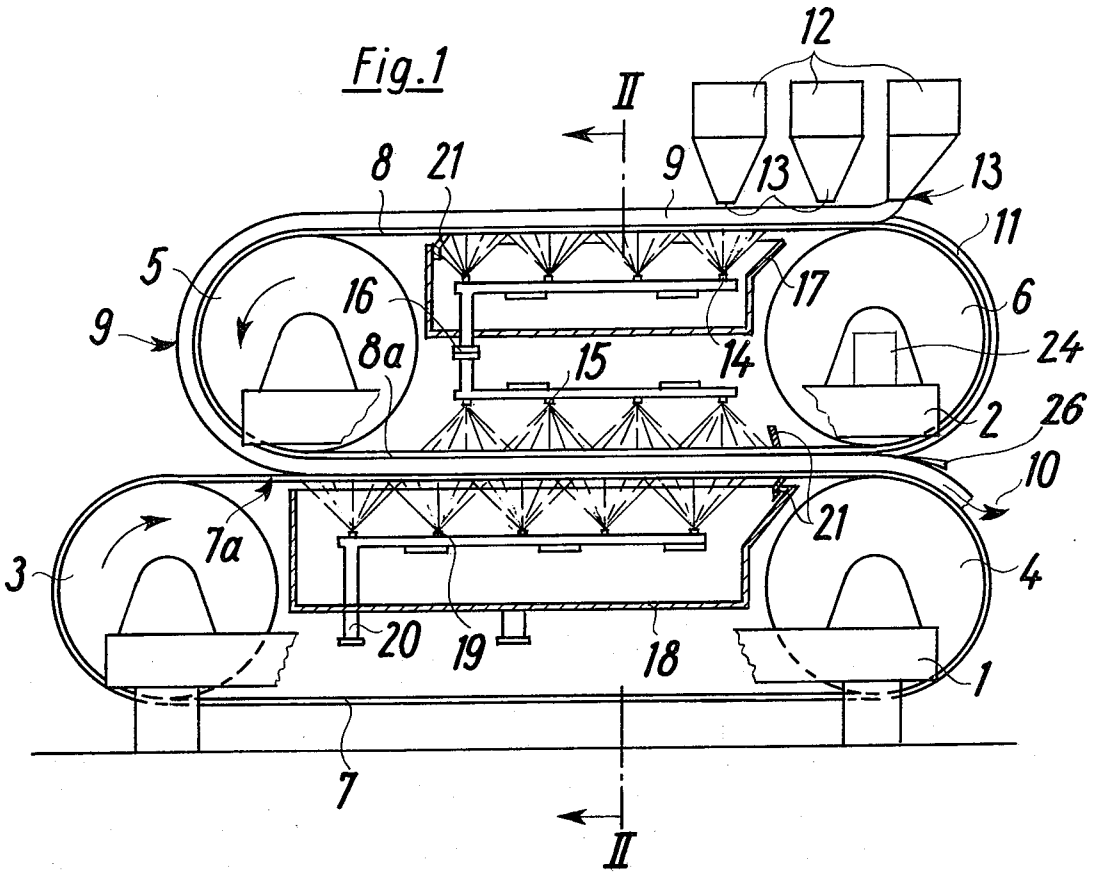
Figure 2:
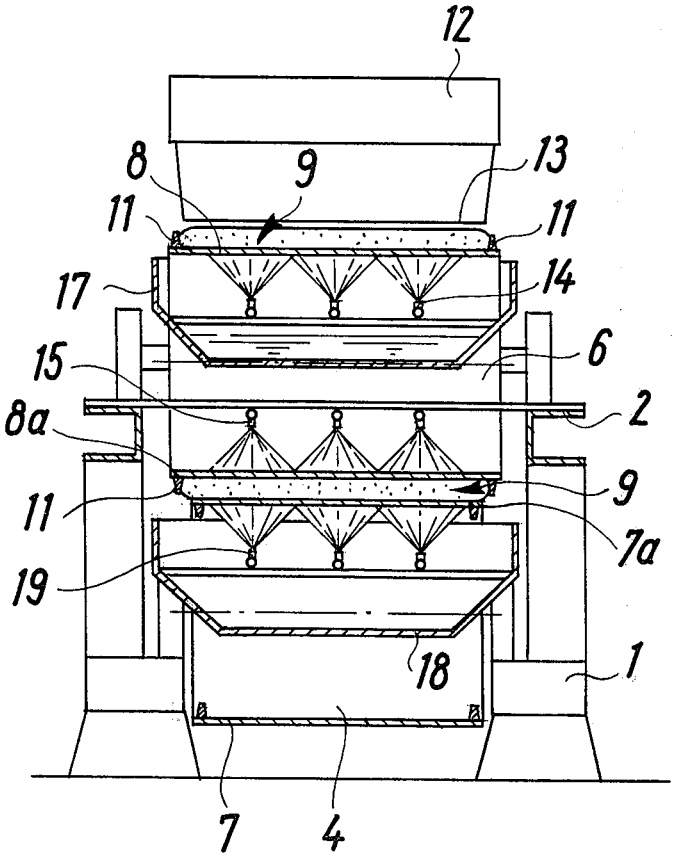

The invention is described below in relation to the embodiment illustrated in the accompanying drawing in which:

FIG. 1 is a diagrammatic longitudinal section through a dual-belt cooling system for the treatment of viscous liquids; and, FIG. 2 is a cross-section taken along the line II—II of FIG. 1.

Referring to the drawings, a pair of endless steel belts 7 and 8 are mounted respectively upon pairs of rolls 3 and 4 and 5 and 6. The belts have coextensive runs 7*a* and 8*a* which form between them a treatment zone of predetermined thickness through which a continuous strip or layer 9 of the product being cooled passes. Rolls 3 and 4 are mounted upon upon a frame 1 and rolls 5 and 6 are mounted upon a frame 2, and frame 2 is adjustable vertically with respect to frame 1 so that the thickness of the treatment zone can be adjusted to a predetermined value. Mounted between the top and bottom runs of belt 8 are two spray assemblies 14 and 15 to which a coolant in the form of chilled brine is supplied through a pipe 16. Spray assembly 14 has a header assembly upon which are mounted 12 spray heads which spray the coolant onto the bottom side of the upper run of belt 8. Spray assembly 15 has a similar array of a header assembly and fifteen spray heads which produce a continuous spray pattern of the chilled brine onto the top surface of the bottom run of belt 8. The brine from spray assembly 14 is collected in a tank 17; and, the brine from spray assembly 15 flows off the side edges of belt run 8*a* (see FIG. 2) and downwardly into a tank 18. A pair of rubber side strips 11 are bonded to belt 8 along the edges of the surface which is the top surface of belt run 8*a*. A wiper strip of squeegee 21 is positioned adjacent the bottom of roll 6 in contact with the top surface of belt run 8*a* and extends between the side edges of the belt so as to divert the brine off the sides of the belt.

Positioned beneath belt run 7*a* is a spray assembly 19 which is formed by 15 spray heads and a header assembly to which chilled brine is supplied through a pipe 20. Spray assembly 19 provides a continuous spray pattern throughout the treatment zone and the brine is collected in tank 18. A wiper strip or squeegee 21 is also positioned adjacent the down-stream edge of tank 18 to insure that the brine is discharged into tank 18. The brine from tanks 17 and 18 is returned to a liquid chiller (not shown), from which it is recirculated.

Positioned above the right-hand end of the upper run of belt 8 are three tanks 12 within which a hot-melt resin is heated to a viscous liquid stage. Each of the tanks has a discharge slot 13 in its bottom wall through which a continuous stream of the resin is discharged onto the belt. Hence, as the belt moves past tanks 12, the three streams of resin build up the layer or strip 9 of the product. The cooling effect of the brine spray from spray assembly 14 quickly starts to cool the product strip. Hence, as the product strip reaches roll 5 it has become sufficiently solidified or set to have a substantially fixed cross-sectional configuration. It also adheres to belt 8 to that it passes around roll 5 and its top surface becomes the bottom surface and moves against belt run 7*a* as the strip enters the treatment zone.

As shown in FIG. 2, the width of the product strip is limited by side strips 11, and the streams flowing from tanks 12 are controlled to produce the cross-sectional area shown. The strip then flows while in the fluid state to the uniform thickness. The product strip is of the same thickness as the treatment zone so that it contacts the coextensive surfaces of the belt runs 7*a* and 8*a*, and it is cooled uniformly from its top and bottom surfaces. Any non-uniformity in the strip is overcome by the action of belt runs 7*a* and 8*a*, and there is some tolerance because of the fact that belt 8 is wider than belt 7 and the side strips 11 aid in supporting the sides of the product strip. Belt 7 has a pair of side strips 22 which are similar to side strips 11 and which extend downwardly from belt run 7*a*. Side strips 22 aid in preventing the brine from spray assembly 15 from going beyond the edges of belt run 7*a*.

It has been indicated above that strip 9 adheres to belt 8 and when strip 9 reaches the treatment zone it also adheres to belt 7. Belt 8 is driven by an electric motor drive unit 24, and belt 7 is then driven from belt 8 by the adhesion of both belts to strip 9. As strip 9 passes from the treatment zone at 10, its adhesion to belt 8 is broken by a doctor blade 26, and the adhesion to belt 7 is broken by a doctor blade (not shown). However, at that time strip 9 is completely solidified and can be broken into pieces of the desired size for use.

The size and the shape of slots 13 in tanks 12 and the rate of movement of belt 8 determine the cross-sectional area of the stream of liquid which forms strip 9. As the liquid is deposited on the belt, it tends to flow toward the belt edges and the rate of cooling is such as to produce the strip cross-section shown in FIG. 9. The cooling is from the bottom surface of the strip so that the partially solidified layer along the belt increases in width until the strip reaches the side strips 11. The strip has then reached substantially its final cross-sectional shape, subject only to the compressing effect when the strip moves against belt 7 and is confined to the thickness of the treatment zone. Spray unit 19 cools belt run **7*a* for a greater distance than belt run 8*a* is cooled by spray unit 15. That is desirable because strip 9 has been cooled some from belt 8**, and bottom side of the strip is at a higher temperature than its top side as it enters the treatment zone.

The precooling and partial solidification of the liquid prior to passage into the treatment zone makes it possible to exert accurate control upon the amount of the product which is being fed to the belt. Hence, it is possible to prevent the creation of voids within the treatment zone because of the transverse flow or spreading action on the lower belt and the resultant impaired cooling action. At the same time, the full cooling capacity of the system is utilized so as to provide maximum output from the machine. That is, strip 9 is sufficiently rigid when it encounters belt 7 to insure that the strip will be compressed between the belts throughout the treatment zone. That insures an acceptable heat-exchange relationship between the strip and each of the belts, and the strip will be cooled properly at 10.

It should be noted (FIG. 2) that belt 8 is wider than belt 7, so that belt 8 overhangs the side edges of belt 7 within the treatment zone. The amount of that overhang is slightly greater than the width of side strips 11 so that both belts contact the product strip for substantially the same width. Also, in this embodiment, slots 13 extend substantially the width of the belt 7. Hence, while the invention contemplates there may be some flow of the product layer toward the edges of belt 8, the feeding means is arranged to keep that flow at a minimum.

It is understood that many possible embodiments may be made incorporating the present invention as defined in the accompanying claims. For example, slots 13 may be a row of holes positioned transversely of the belt. Under some circumstances strips 11 may be omitted, so that the width of the product strip is controlled solely by the precooling action.

We claim:

1. In a dual-belt cooling system having upper and lower endless belts each of which is mounted upon a pair of horizontally spaced rolls and has an upper run and a lower run, wherein the lower run of the upper belt and the upper run of the lower belt are spaced from each other and define a treatment zone which is substantially rectangular in cross-section and through which a product layer passes in direct heat exchange relationship with coextensive surfaces of both of said belts, and means for providing a coolant in contact with the surfaces of said belts which are on the opposite sides of said coextensive surfaces whereby heat is extracted from the opposite sides of said product layer through the respective belts and to the coolant, the upper surface of said upper run of said upper belt extending horizontally, that improvement which comprises feed means to deposit said product layer upon said top surface of said upper run of said upper belt whereby the product layer passes along said upper run and thence downwardly through an arc of the order of 180° around one of said drums and enters said treatment zone, and cooling means to supply coolant to the bottom surface of said upper run of said upper belt and thereby precool the product layer and solidify it sufficiently to ensure that the product layer will maintain continuous contact with both belts when passing through said treatment zone.

2. A dual-belt cooling system as defined in claim 1, wherein said cooling means comprises a spray-nozzle arrangement through which brine coolant is sprayed.

3. A dual-belt cooling system as defined in claim 1, wherein said feed means are melting pots which are provided at their lower end with discharge slots.

4. A dual-belt cooling system as defined in claim 3, wherein said upper belt is provided with two side strips and said discharge slots and said lower belt are of a width substantially equal to the width of the upper belt between said side strips.

* * * * *